US009790577B2

(12) United States Patent
Kim et al.

(10) Patent No.: US 9,790,577 B2
(45) Date of Patent: Oct. 17, 2017

(54) TI—AL-BASED ALLOY INGOT HAVING DUCTILITY AT ROOM TEMPERATURE

(71) Applicant: Korea Institute of Machinery & Materials, Daejeon-si (KR)

(72) Inventors: Seong Woong Kim, Gyeongsangnam-do (KR); Seung Eon Kim, Gyeongsangnam-do (KR); Young Sang Na, Gyeongsangnam-do (KR); Jong Taek Yeom, Gyeongsangnam-do (KR)

(73) Assignee: KOREA INSTITUTE OF MACHINERY & MATERIALS (KR)

( * ) Notice: Subject to any disclaimer, the term of this patent is extended or adjusted under 35 U.S.C. 154(b) by 223 days.

(21) Appl. No.: 14/091,543

(22) Filed: Nov. 27, 2013

(65) Prior Publication Data

US 2014/0341775 A1 Nov. 20, 2014

(30) Foreign Application Priority Data

May 20, 2013 (KR) ..... 10-2013-0056313

(51) Int. Cl.
*C22C 14/00* (2006.01)
*C22C 30/00* (2006.01)
*C22C 21/00* (2006.01)

(52) U.S. Cl.
CPC ..... *C22C 14/00* (2013.01); *C22C 21/00* (2013.01); *C22C 30/00* (2013.01)

(58) Field of Classification Search
CPC ..... C22C 14/00; C22C 30/00
(Continued)

(56) References Cited

U.S. PATENT DOCUMENTS 4,294,615 A 10/1981 Blackburn et al.
4,842,819 A 6/1989 Huang et al.
(Continued)

FOREIGN PATENT DOCUMENTS

JP 10193087 7/1998
JP 10220236 8/1998
KR 101261885 5/2013

OTHER PUBLICATIONS

Kuhn, Howard Medlin, Dana. (2000). ASM Handbook, vol. 08—Mechanical Testing and Evaluation—11.3 Properties from Test Results. ASM International.*
(Continued)

*Primary Examiner* — Jessee Roe
*Assistant Examiner* — Jeremy Jones
(74) *Attorney, Agent, or Firm* — Brooks Kushman P.C.

(57) ABSTRACT

There is provided a Ti—Al-based alloy ingot having ductility at room temperature, in which the Ti—Al-based ingot has a lamellar structure in which $\alpha_2$ phases and $\gamma$ phases are arranged sequentially and regularly, and a thickness ratio $\gamma/\alpha_2$ of the $\gamma$ phase to the $\alpha_2$ phase is equal to or more than 2. There is also provided a Ti—Al-based alloy ingot having ductility at room temperature, in which the Ti—Al-based alloy ingot has a lamellar structure in which $\alpha_2$ phases and $\gamma$ phases are arranged sequentially and regularly, the $\gamma$ phase has a thickness of 100 nm to 200 nm, and the $\alpha_2$ phase has a thickness of 100 nm or less.

8 Claims, 11 Drawing Sheets

EMBODIMENT 1

(58) Field of Classification Search
USPC ..... 420/418, 588
See application file for complete search history.

(56) References Cited

U.S. PATENT DOCUMENTS

| | | | | | |
|---|---|---|---|---|---|
| 4,842,820 | A | | 6/1989 | Huang et al. | |
| 4,879,092 | A | | 11/1989 | Huang | |
| 5,296,056 | A | * | 3/1994 | Jain | C22C 14/00 148/403 |
| 5,653,828 | A | * | 8/1997 | Zhao | C22F 1/183 148/669 |
| 5,908,516 | A | * | 6/1999 | Nguyen-Dinh | C22C 14/00 148/421 |
| H001988 | H | * | 9/2001 | Kim | C22C 14/00 148/669 |
| 2004/0045644 | A1 | * | 3/2004 | Guther | C22C 14/00 148/538 |
| 2004/0071585 | A1 | * | 4/2004 | Hashimoto | C22C 14/00 420/418 |
| 2010/0252146 | A1 | * | 10/2010 | Qu | C22C 14/00 148/281 |

OTHER PUBLICATIONS

Sawatzky et al. Materials Science Forum 2010, vols. 654-656, p. 500-503, "The Effect of Heat Treatments on Microstructure and Creep Properties of Powder Metallurgy Beta Gamma Titanium Aluminide Alloys."

Niu et al. Intermetallics 2012, vol. 21, p. 97-104, "Effect of pack rolling on microstructures and tensile properties of as-forged Ti-44Al-6V-3Nb-0.3zY alloy."

* cited by examiner

| CATEGORY | COMPOSITION (at. %) |
|---|---|
| COMPARATIVE EXAMPLE 1 | Ti-47.21Al-6.28Nb-0.49Cr-0.28Si-0.15Ni-0.17V |
| COMPARATIVE EXAMPLE 2 | Ti-44Al-6Nb-2Cr-0.3Si-0.1C |
| EMBODIMENT 1 | Ti-46Al-6Nb-0.5W-0.5Cr-0.3Si-0.1C |
| EMBODIMENT 2 | Ti-44Al-6Nb-0.5W-0.5Cr-0.3Si-0.1C |

COMPARATIVE EXAMPLE 2

EMBODIMENT 1

COMPARATIVE EXAMPLE 2

EMBODIMENT 1

COMPARATIVE EXAMPLE 2

EMBODIMENT 1

COMPARATIVE EXAMPLE 2

EMBODIMENT 1

| | |
|---|---|
| UTS(MPa) | 705.65304 |
| Yield stress(MPa) | 562.54863 |
| Strain(%) | 0.693 |

| | |
|---|---|
| UTS(MPa) | 639.68 |
| Yield stress(MPa) | 589.59 |
| Strain(%) | 0.384 |

| | |
|---|---|
| COMPARATIVE EXAMPLE 1-1 | INCREASE OF 2.6593 mg / cm$^2$ |
| COMPARATIVE EXAMPLE 2-1 | INCREASE OF 3.55922 mg / cm$^2$ |
| COMPARATIVE EXAMPLE 1-2 | INCREASE OF 1.817547mg / cm$^2$ |
| COMPARATIVE EXAMPLE 2-2 | INCREASE OF 2.4442 mg / cm$^2$ |
| COMPARATIVE EXAMPLE 1-3 | INCREASE OF 2.00811 mg / cm$^2$ |
| EMBODIMENT 2 | INCREASE OF 1.040486 mg/cm$^2$ |
| EMBODIMENT 1 | INCREASE BY 1.072683 mg/cm$^2$ |

FIG. 12

| CATEGORY | COMPARATIVE EXAMPLE 1 | COMPARATIVE EXAMPLE 1 | EMBODIMENT 1 | PATENT CRITERION |
|---|---|---|---|---|
| Grain size (μm) | 152.3 | 196.6 | 308.7 | |
| γ lamellar width (nm) | 215 | 70.6 | 170.2 | 100 ~ 200 nm |
| $\alpha_2$ lamellar width (nm) | 120 | 57.2 | 81.8 | 100 nm OR LESS |
| $\gamma/\alpha_2$ ratio | 1.79 | 1.23 | 2.08 | 2 OR MORE |
| $\alpha_2$-$\alpha_2$ spacing | 230 | 83.6 | 186.8 | 100 ~ 200 nm |

TI—AL-BASED ALLOY INGOT HAVING DUCTILITY AT ROOM TEMPERATURE

CROSS-REFERENCE TO RELATED APPLICATIONS

This application claims the priority of Korean Patent Application No. 10-2013-0056313 filed on May 20, 2013, in the Korean Intellectual Property Office, the disclosure of which is incorporated herein by reference.

BACKGROUND

Technical Field

The present disclosure relates to a Ti—Al-based alloy ingot having ductility at room temperature, and more particularly, to a Ti—Al-based alloy ingot having ductility at room temperature, which has a lamellar structure in which $\alpha_2$ phases and $\gamma$ phases are arranged subsequently and regularly and has ductility at room temperature in a casting state where the subsequent heat treatment is not performed by controlling a width of the $\alpha_2$ phase, a width of the $\gamma$ phase and a ratio of $\alpha_2/\gamma$.

Description of the Related Art

A Ti—Al-based alloy is a kind of intermetallic compounds that have been spotlighted as an advanced light-weight heat-resistant material, and is a two-phase alloy including about 10% of $Ti_3Al$.

An ingot having a two-phase lamellar structure of TiAl ($\gamma$)+$Ti_3Al$($\alpha_2$) is produced by a typical melt solidification method.

Due to superiority in fracture toughness, fatigue strength and creep strength, a lamella structure of the TiAl enables the TiAl to exhibit characteristics useful to be practicalized as a light-weight high-temperature material, but it is difficult for the TiAl to be used as a casting material because of insufficient ductility at room temperature.

Such insufficient ductility is primarily caused by delamination occurring at a lamellar boundary when stress is vertically applied to the boundary.

Accordingly, by reducing sizes of crystal grains and adding beta and gamma phases having relatively excellent ductility as compared with the lamellar structure, there have been efforts to improve strength and ductility of the TiAl as well as high-temperature characteristics.

In the related art for producing the TiAl alloy having a lamellar structure including beta and gamma phases, a Ti—(41~45)Al—(3~5)Nb—(Mo,V)—(B,C)-based alloy is used (H. Z. Niu et al., intermetallics 21 (2012) 97 and T. Sawatzky, Y. W. Kim et al., Materials Science Forum, 654-656 (2010) 500)).

Further, U.S. Pat. No. 4,294,615 discloses a technology of improving ductility of a TiAl by adding vanadium (V) to a gamma TiAl matrix, and U.S. Pat. No. 4,842,820 discloses a technology of improving strength and ductility of a TiAl by adding Boron (B).

In addition, U.S. Pat. Nos. 4,842,819 and 4,879,092 disclose a technology of improving ductility of a TiAl by adding chrome (Cr) and a technology of improving ductility and oxidation resistance of a TiAl by simultaneously adding chrome and niobium, respectively.

Disadvantageously, in the aforementioned related arts, since hot processing such as hot forging, rapid solidification, and hot extrusion are performed on the TiAl, it is difficult to simply predict from a result of such hot processing whether or not characteristics of a casting body are improved.

Moreover, since mechanical characteristics are tested through a high-temperature measurement or a bending test is performed, it is difficult to understand tensile properties at room temperature.

SUMMARY

In order to solve the above-described problems, an aspect of the present disclosure provides a Ti—Al-based alloy ingot having ductility at room temperature in a casting state.

An aspect of the present disclosure also provides a Ti—Al-based alloy ingot having ductility at room temperature, which has a lamellar structure in which $\alpha_2$ phases and $\gamma$ phases are arranged subsequently and regularly and has ductility at room temperature in a casting state where the subsequent heat treatment is not performed by controlling a width of the $\alpha_2$ phase, a width of the $\gamma$ phase and a ratio of $\alpha_2/\gamma$.

An aspect of the present disclosure also provides a Ti—Al-based alloy ingot having ductility at room temperature with which it is possible to improve high-temperature characteristics as well as room-temperature characteristics.

According to an aspect of the present disclosure, there is provided a Ti—Al-based alloy ingot having ductility at room temperature. The Ti—Al-based ingot may have a lamellar structure in which $\alpha_2$ phases and $\gamma$ phases are arranged sequentially and regularly, and a thickness ratio $\gamma/\alpha_2$ of the $\gamma$ phase to the $\alpha_2$ phase may be equal to or more than 2.

According to another aspect of the present disclosure, there is provided a Ti—Al-based alloy ingot having ductility at room temperature. The Ti—Al-based alloy ingot may have a lamellar structure in which $\alpha_2$ phases and $\gamma$ phases are arranged sequentially and regularly, the $\gamma$ phase may have a thickness of 100 nm to 200 nm, and the $\alpha_2$ phase may have a thickness of 100 nm or less.

The Ti—Al-based alloy ingot may include 44 to 46 at % of aluminum (Al), 6 at % of niobium (Nb), 1.0 at % of creep-property improver, 1.0 at % of softening-resistant improver, and titanium (Ti) as a remainder.

The creep-property improver may include carbon (C) and silicon (Si).

The softening-resistant improver may include tungsten (W) and chrome (Cr).

The Ti—Al-based alloy ingot may have a tensile strength of 640 MPa or more.

BRIEF DESCRIPTION OF THE DRAWINGS

The above and other aspects, features and other advantages of the present disclosure will be more clearly understood from the following detailed description taken in conjunction with the accompanying drawings, in which:

FIG. 12 shows Table of representing a comparison result of major factors of microstructures of the Ti—Al-based alloy ingot having ductility at room temperature according to Embodiments of the present disclosure and the Ti—Al-based alloy ingot according to Comparative Examples.

DETAILED DESCRIPTION

Figures 1, 2:
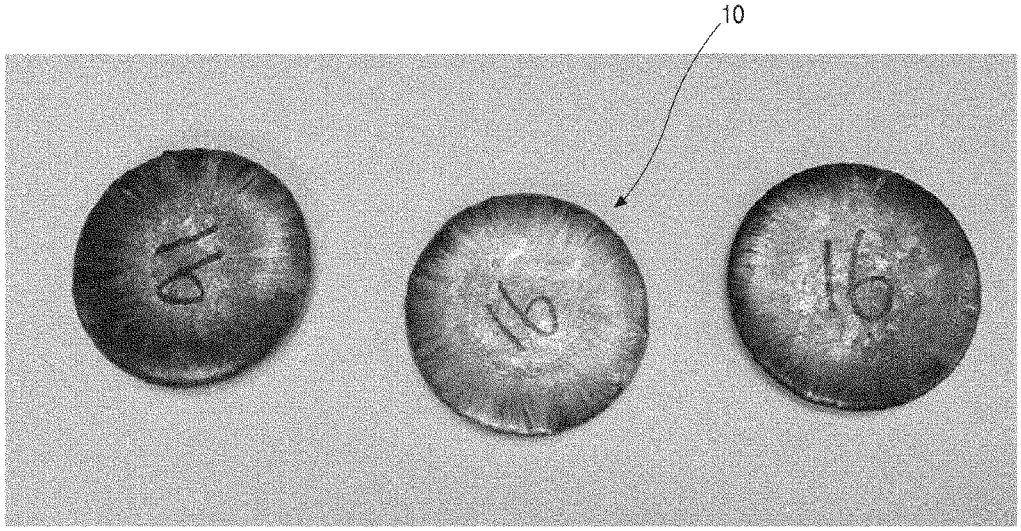
FIG. 1 is a photograph showing an actual external appearance of a Ti—Al-based alloy ingot having ductility at room temperature according to the present disclosure.
FIG. 2 is Table showing compositions of the Ti—Al-based alloy ingot having ductility at room temperature according to the present disclosure and Ti—Al-based alloy ingots according to Comparative Examples.

As required, detailed embodiments are disclosed herein. However, it is to be understood that the disclosed embodiments are merely exemplary. Additionally, the features of various implementing embodiments may be combined to form further embodiments. The figures are not necessarily to scale and features may be exaggerated or minimized to show details of particular components. Therefore, specific structural and functional details disclosed herein are not to be interpreted as limiting, but merely as a representative basis for teaching one skilled in the art.

As set forth above, according to embodiments of the present disclosure, there is a merit that it is possible to provide a Ti—Al-based alloy ingot having ductility at room temperature in a casting state, which has a lamellar structure in which $\alpha_2$ phases and $\gamma$ phases are arranged subsequently and regularly.

Further, there is also a merit that the Ti—Al-based alloy ingot has ductility at room temperature in a casting state where the subsequent heat treatment is not performed by controlling a width of the $\alpha_2$ phase, a width of the $\gamma$ phase and a ratio of $\alpha_2/\gamma$.

Furthermore, there is also a merit that high-temperature characteristics are improved as well as high-temperature characteristics.

Hereinafter, a Ti—Al-based alloy ingot having ductility at room temperature according to the present disclosure will be described with reference to FIGS. 1 and 2.

Before the description thereof, all terms and words used in the specifications and claims are not interpreted as the meaning generally used in the dictionary, but should be interpreted as the meaning and concept coincident with the technological sprit of the present disclosure on the basis of a fundamental rule that an inventor can suitably define the concept of corresponding terms to describe his or her disclosure using the best method.

Accordingly, embodiments described in the specifications and configurations illustrated in the drawings are merely a preferred embodiment, and do not wholly represent the technical sprit of the present disclosure. Therefore, it should be appreciated that various modifications and equivalents to these embodiments are possible at the time of filing the present application.

FIG. 1 is a photograph showing an actual external appearance of a Ti—Al-based alloy ingot having ductility at room temperature according to the present disclosure, and FIG. 2 is Table showing compositions of the Ti—Al-based alloy ingot having ductility at room temperature according to the present disclosure and Ti—Al-based alloy ingots according to Comparative Examples.

As shown in the drawings, the Ti—Al-based alloy ingot (hereinafter, referred to as a Ti—Al alloy 10) having ductility at room temperature according to the present disclosure is produced by a solidification casting method on the basis of compositions having an atom ratio of components represented in Embodiment 1 and Embodiment 2 shown in FIG. 2, and subsequent processes such as heat treatment, hot isostatic pressing, rolling and forging are not performed on the Ti—Al alloy.

More specifically, when the subsequent process such as heat treatment is performed on the Ti—Al alloy 10, it is obvious that mechanical characteristics such as hardness, softening resistance and creep properties of the Ti—Al alloy are improved. However, the hardness and tensile strength of button-shaped Ti—Al alloys according to Embodiments of the present disclosure, which have diameters of 60 mm and are produced by the solidification casting method, are tested and compared with Ti—Al alloys according to Comparative Examples.

At this time, a Ti—Al alloy according to Comparative Example 1 is produced based on a TiAl heat-resistant alloy composition described in Japanese Patent Laid-Open Publication Nos. H10-220236 and H10-193087 filed by Daido Steel Co., Ltd in Japan, and a Ti—Al alloy according to Comparative Example 2 is produced based on a TiAl alloy composition described in Korean Patent No. 10-1261885.

Embodiments of the present disclosure are divided into Embodiment 1 and Embodiment 2 according to a difference in composition of aluminum (Al).

That is, the Ti—Al alloys according to Embodiments include 6 at % of niobium (Nb), 1.0 at % of softening-resistant improver, 1.0 at % of creep-property improver, and titanium (Ti) as a remainder, and have slightly different aluminum (Al) compositions of 44 at % and 46 at %, respectively.

At this time, the creep-property improver includes carbon (C) and silicon (Si), and the softening-resistant improver includes tungsten (W) and chrome (Cr). Further, the Ti—Al alloys according to Embodiments have a tensile strength of 640 MPa or more in a state where the subsequent process such as heat treatment is not performed.

Next, microstructures of the Ti—Al alloy according to Embodiment 1 of the present disclosure and the Ti—Al alloys according to Comparative Examples 1 and 2 are compared with reference to FIGS. 3 to 7.

Figure 3:
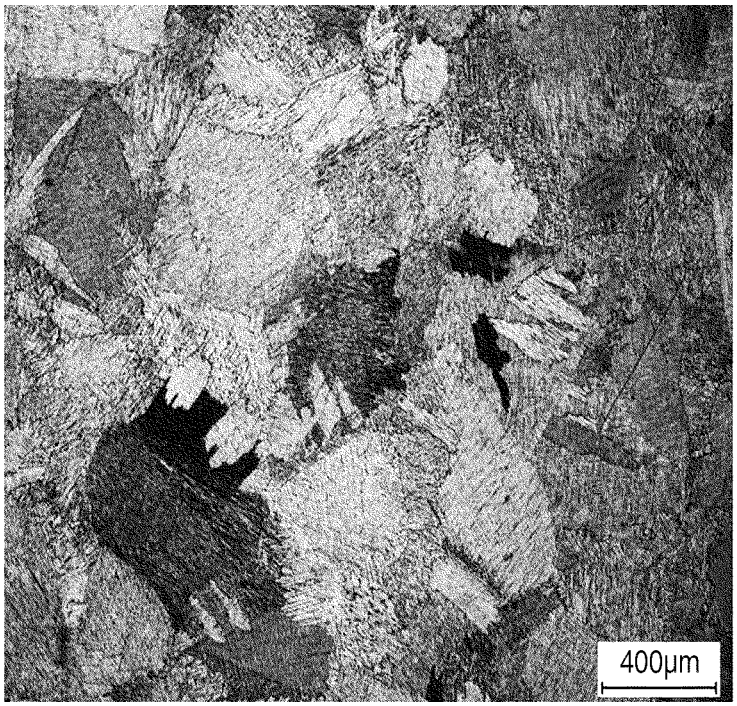
FIG. 3 shows optical microscope photographs of the Ti—Al-based alloy ingot having ductility at room temperature according to the present disclosure and the Ti—Al-based alloy ingot according to Comparative Example 2.
Figure 3:
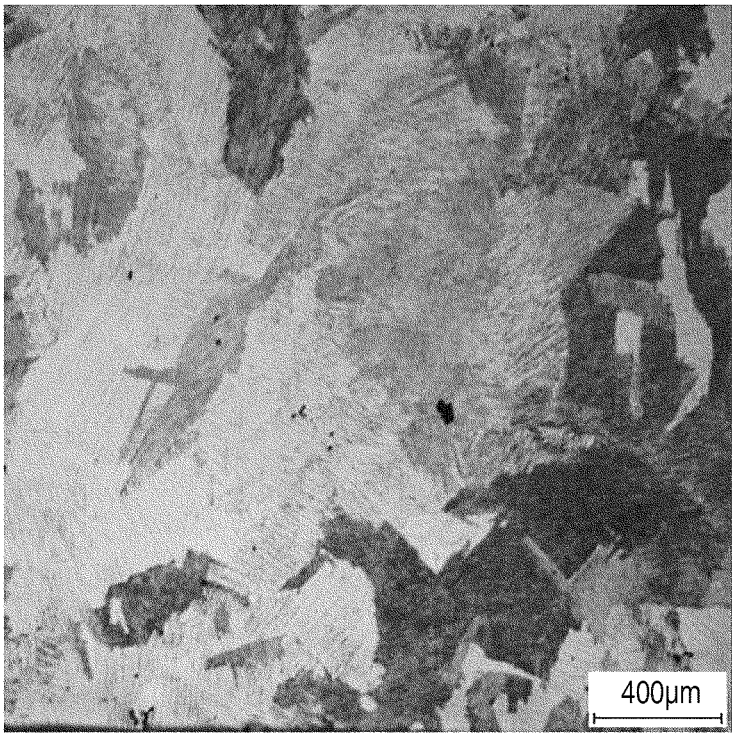
Figure 4:
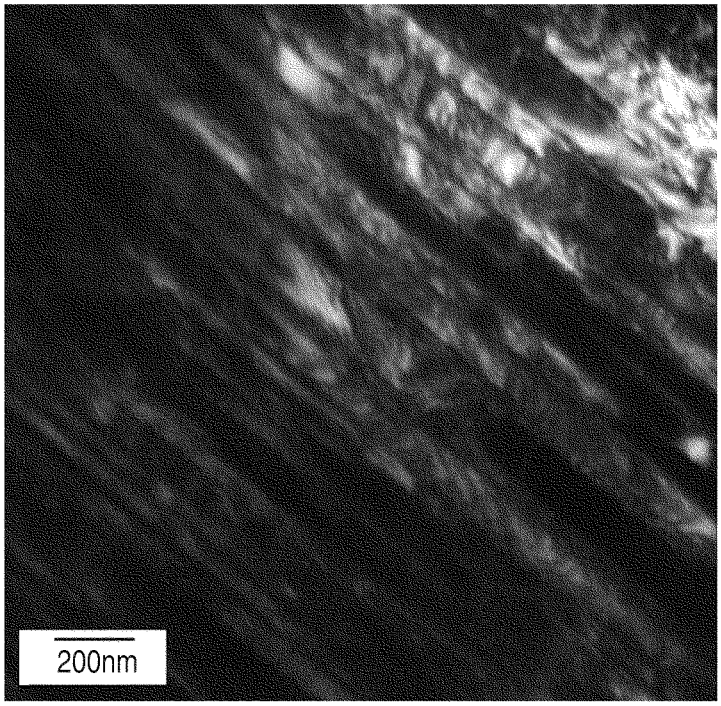
FIG. 4 shows transmission electron microscope photographs of dark field images of the Ti—Al-based alloy ingot having ductility at room temperature according to the present disclosure and the Ti—Al-based alloy ingot according to Comparative Example 2.
Figure 4:
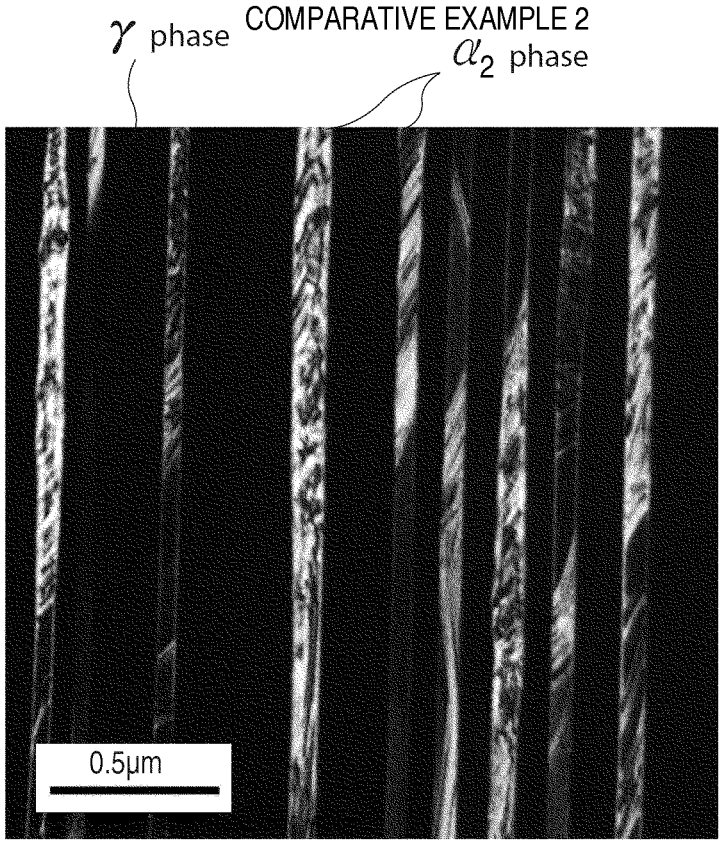
Figure 5:
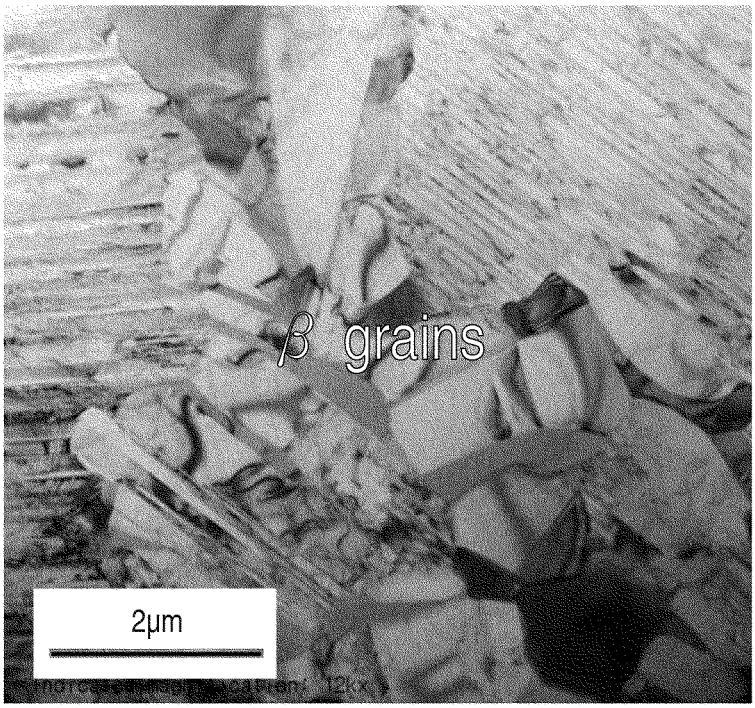
FIG. 5 shows transmission electron microscope photographs of bright field images of the Ti—Al-based alloy ingot having ductility at room temperature according to the present disclosure and the Ti—Al-based alloy ingot according to Comparative Example 2.
Figure 5:
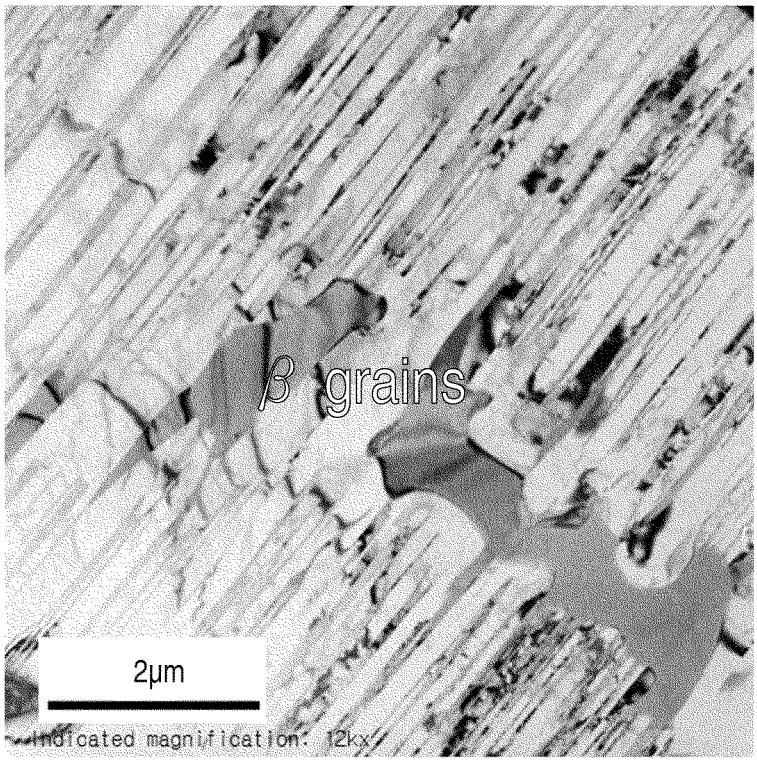
Figure 6:
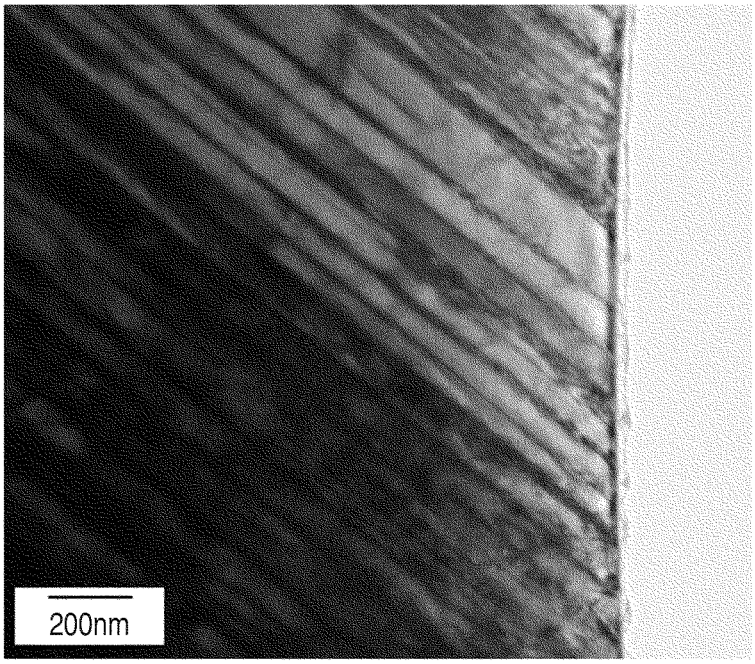
FIG. 6 shows high-magnification transmission electron microscope photographs of bright field images of the Ti—Al-based alloy ingot having ductility at room temperature according to the present disclosure and the Ti—Al-based alloy ingot according to Comparative Example 2.
Figure 6:
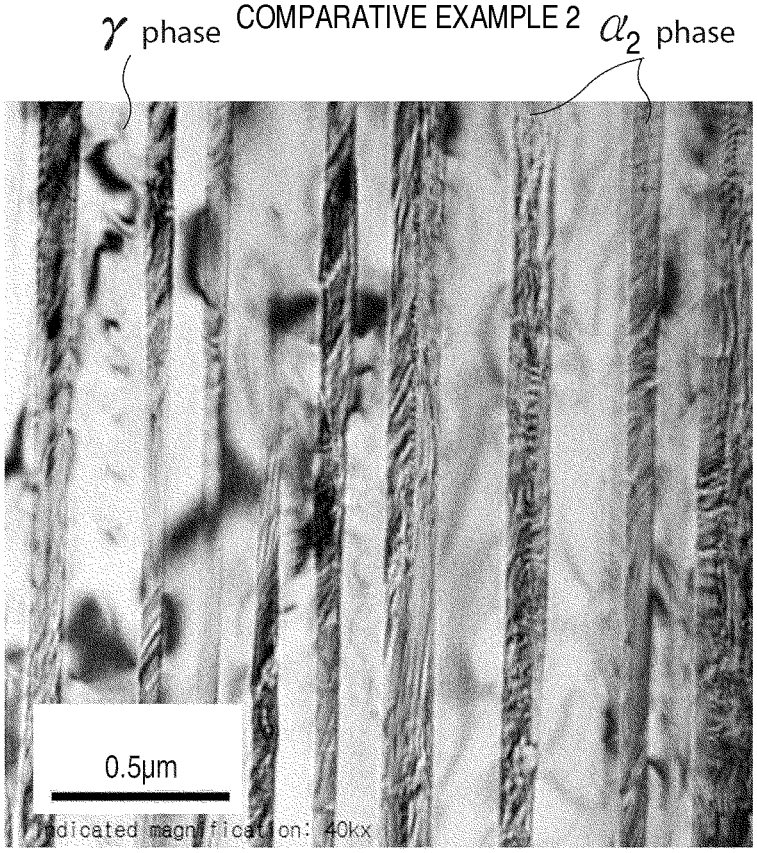
Figure 7:
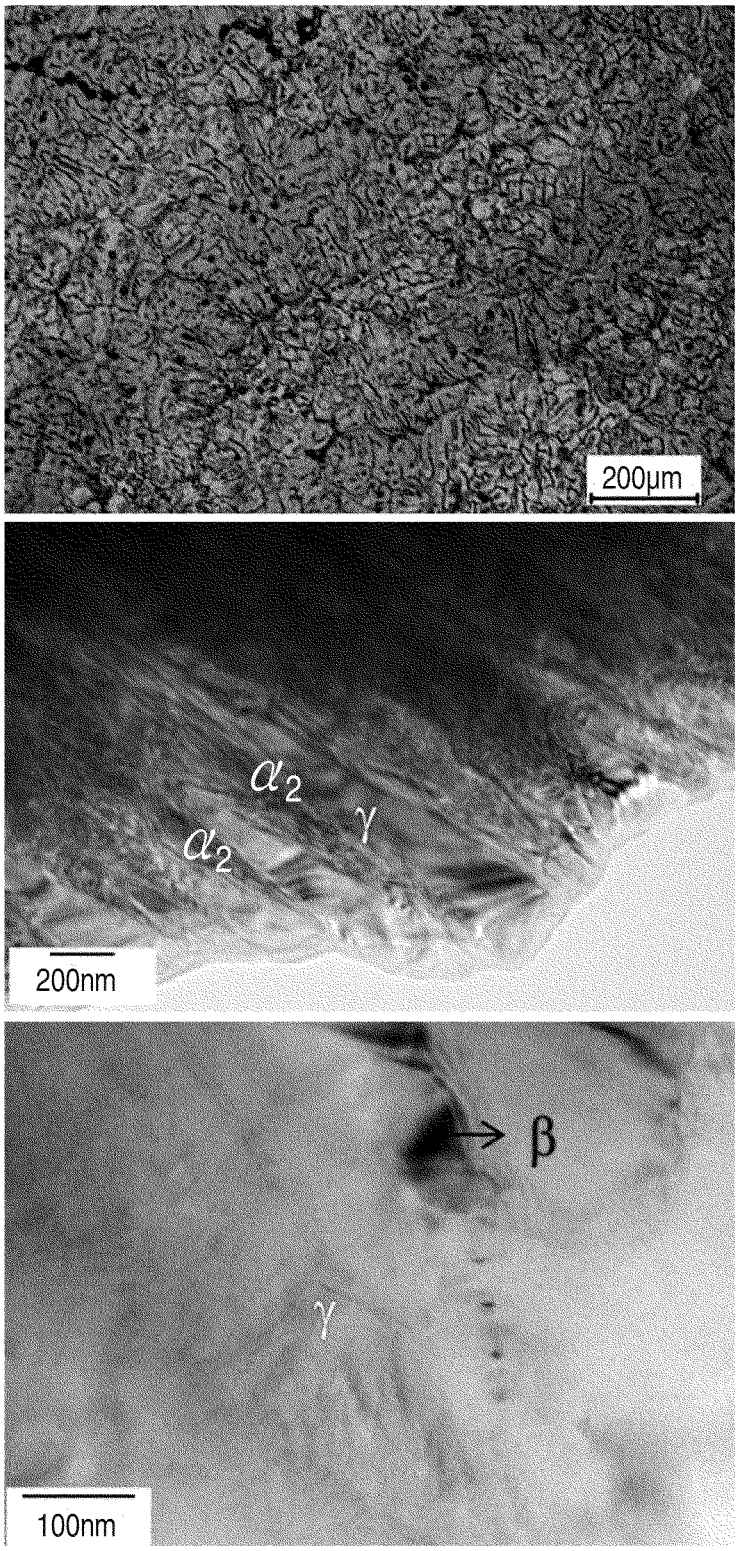
FIG. 7 shows an optical microscope photograph and a transmission electron microscope photograph of the Ti—Al alloy according to Comparative Example 1.

FIG. 3 shows optical microscope photographs of the Ti—Al-based alloy ingot having ductility at room temperature according to the present disclosure and the Ti—Al alloy according to Comparative Example 2, FIGS. 4 to 6 are transmission electron microscope photographs of dark field images and bright field images of the Ti—Al alloy according to Embodiment 1 and the Ti—Al alloy according to Comparative Example 2, and FIG. 7 shows an optical microscope photograph and a transmission electron microscope photograph of the Ti—Al alloy according to Comparative Example 1.

First, as shown in FIG. 3, it can be seen that the Ti—Al alloy according to Embodiment of the present disclosure has more coarse crystal grains than those of the Ti—Al alloy according to Comparative Example 2 and the Ti—Al alloy according to Comparative Examples 1 and 2 has more dense crystal grains than those of the Ti—Al alloy according to Embodiment.

Further, as shown in FIGS. 4 to 6, the Ti—Al alloy according to Embodiment 1 has a lamellar structure in which $\alpha_2$ phases and $\gamma$ phases are arranged subsequently and regularly. However, in the Ti—Al alloy according to Comparative Example, a boundary of a lamellar structure is not unclear.

Furthermore, it can be seen that the Ti—Al alloy according to Embodiment 1 has a lamellar structure, a thickness ratio $\gamma/\alpha_2$ of the $\gamma$ phase to the $\alpha_2$ phase is equal to or more than 2, and a thickness of the $\alpha_2$ phase is thinner than a thickness of the $\gamma$ phase.

Namely, the $\alpha_2$ phase has a thickness of 100 nm or less, whereas the $\gamma$ phase has a thickness of 100 nm to 200 nm. Thus, the $\alpha_2$ phase has a thickness relatively thinner than that of the $\gamma$ phase, and the $\alpha_2$ phases and the $\gamma$ phases are alternately arranged in a lamellar structure.

In contrast, as shown in FIG. 7, similarly to Comparative Example 2, in the Ti—Al alloy according to Comparative Example 1, the $\gamma$ phases each having a thickness of 200 nm or more exist, and the $\alpha_2$ phases have thicknesses of 120 nm.

Moreover, as shown in the lowest photograph of FIG. 7, a plurality of $\beta$ and $\gamma$ crystal grains not having a layered structure are observed from the Ti—Al alloy according to Comparative Example 1.

Figure 8:
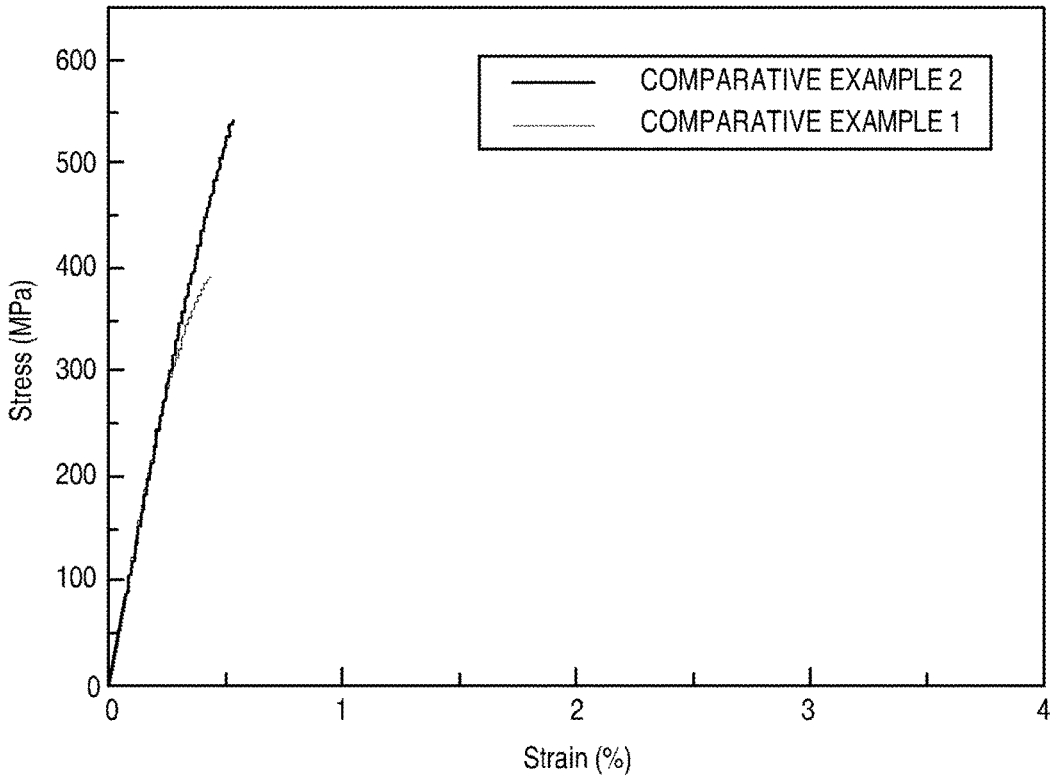
FIG. 8 illustrates stress-strain curves of the Ti—Al alloys according to Comparative Examples 1 and 2.

FIG. 8 illustrates stress-strain curves of the Ti—Al alloys according to Comparative Examples 1 and 2, and the Ti—Al alloys have a tensile strength of 300 MPa to 500 MPa and a strain of less than 0.5%.

Figure 9:
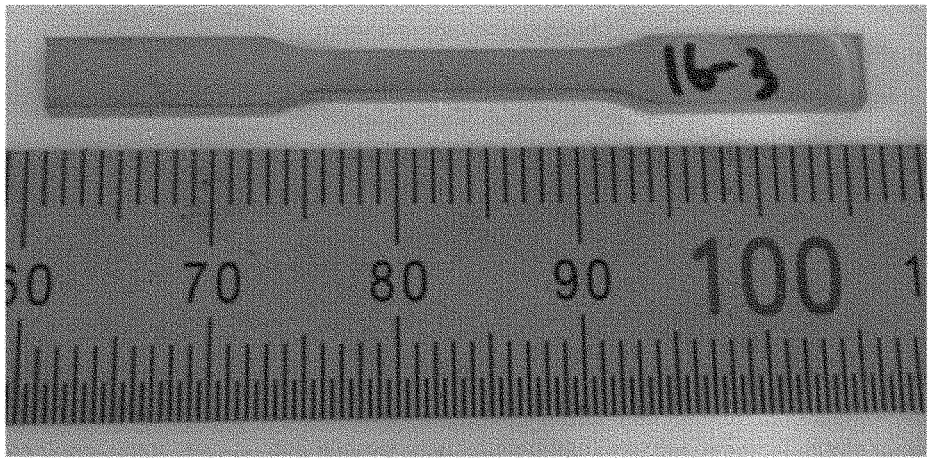
FIG. 9 illustrates a specimen photograph and stress-strain curves of the Ti—Al-based alloy ingot having ductility at room temperature according to the present disclosure.
Figure 9:
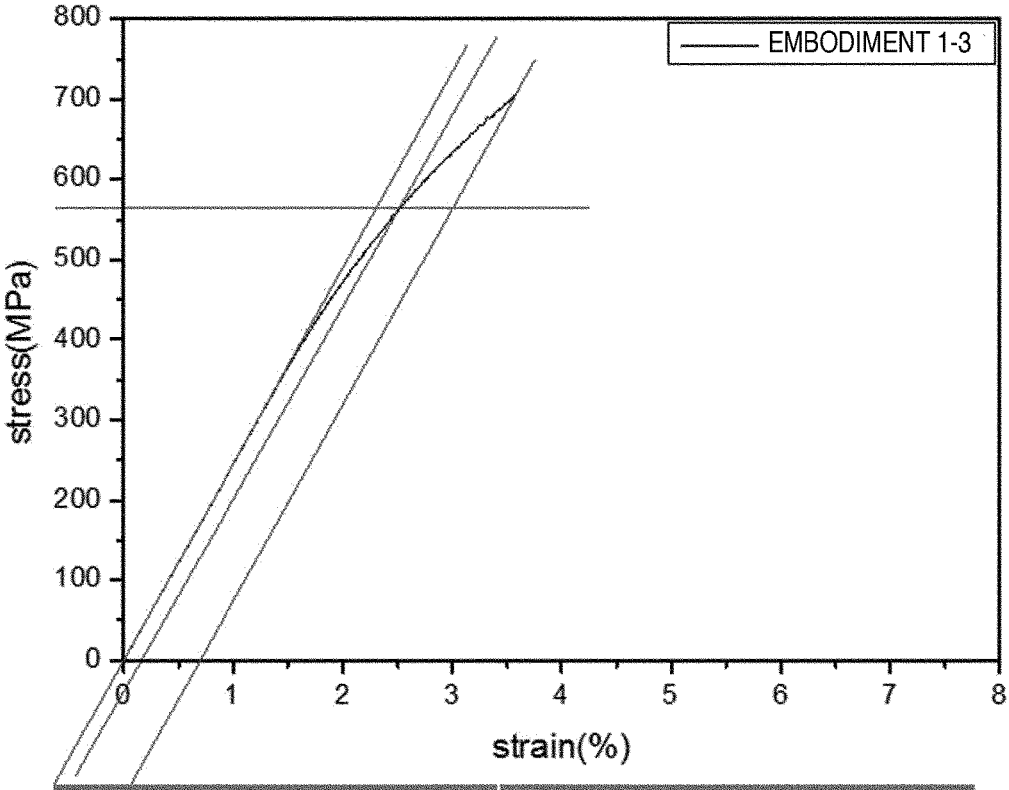
Figure 10:
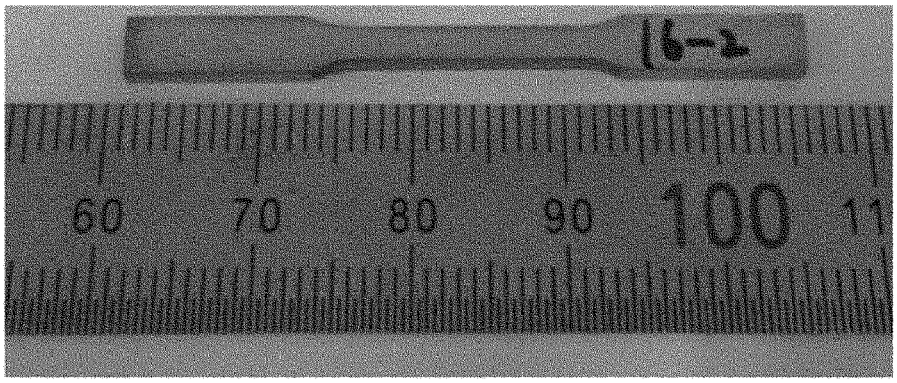
FIG. 10 illustrates a specimen photograph and stress-strain curves of the Ti—Al-based alloy ingot having ductility at room temperature according to the present disclosure.
Figure 10:
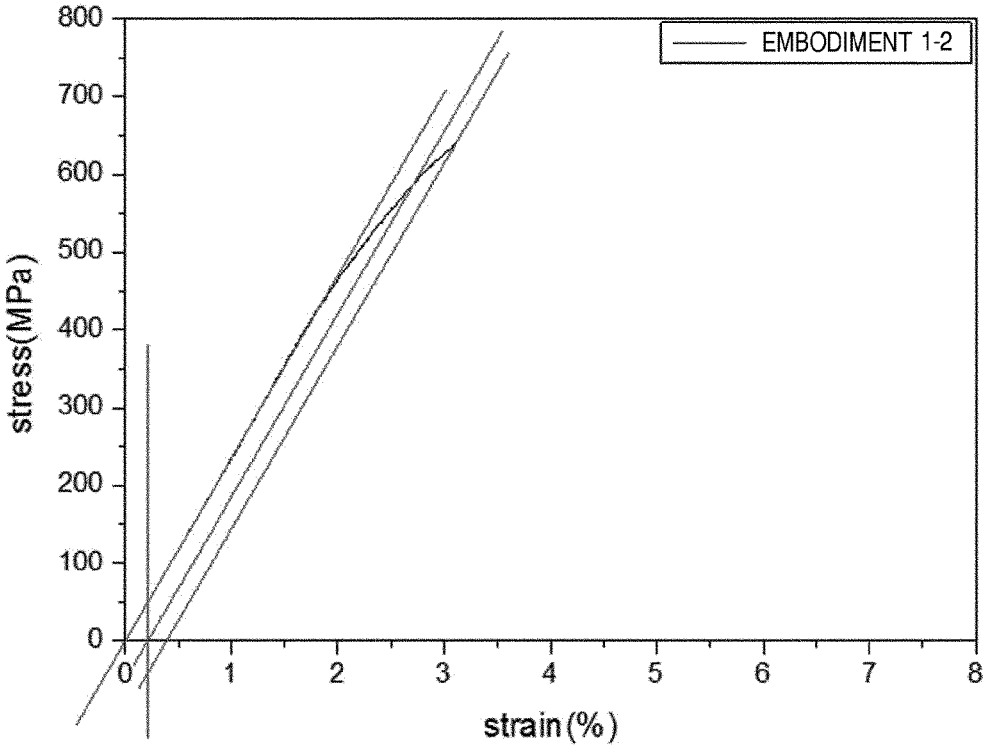

When characteristics of the Ti—Al alloys according to Embodiments shown in FIGS. 9 and 10 are compared with characteristics of the Ti—Al alloys according to Comparative Examples, the Ti—Al alloy according to Embodiment 1 of the present disclosure has a tensile strength of 640 MPa or more, a yield stress of 590 MPa or more and a strain of 0.384% or more.

Here, the Ti—Al alloy according to Embodiment 1 of the present disclosure has tensile strength far superior to the Ti—Al alloy according to Comparative Examples.

The above-mentioned experiment results are obtained by measuring the Ti—Al alloy according to Embodiment 1, which is produced by the solidification casting method based on the compositions represented in FIG. 2. Here, the subsequent processes such as heat treatment and plastic processing are not performed on the Ti—Al alloy.

Accordingly, when the subsequent processes are further performed on the Ti—Al alloy, it is expected that such characteristics can be more improved. Thus, as shown in FIG. 11, an isothermal oxidation test is performed on the Ti—Al alloy at 900° C.

Figure 11:
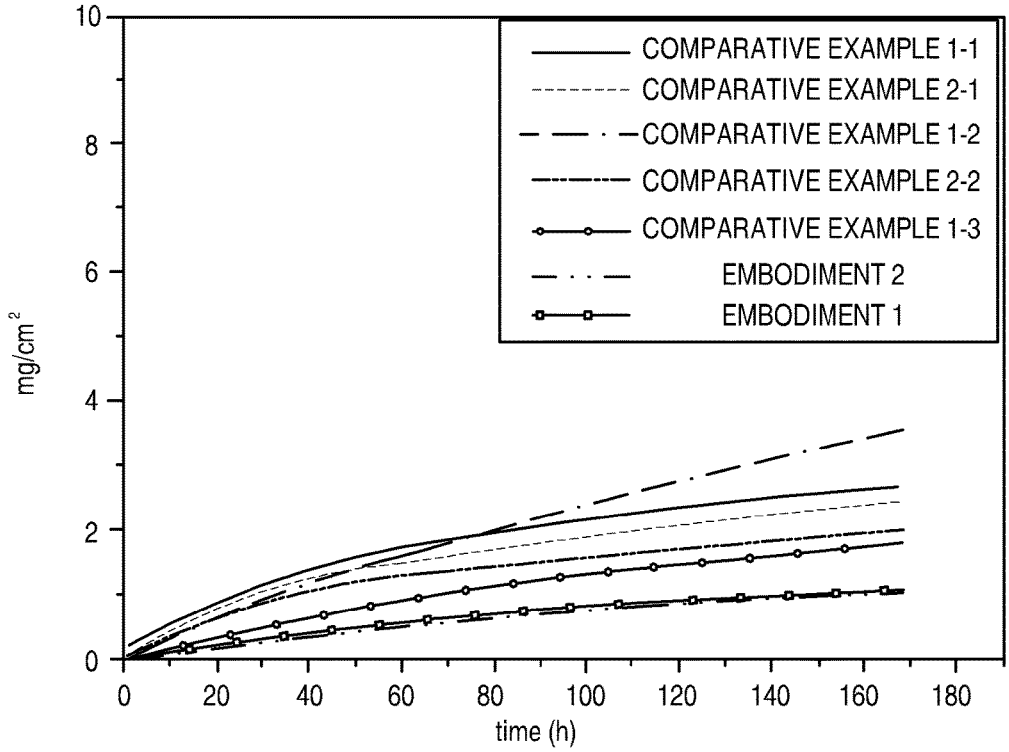
FIG. 11 shows a graph and Table of representing isothermal oxidation test results of the Ti—Al-based alloy ingot having ductility at room temperature according to Embodiments of the present disclosure and the Ti—Al-based alloy ingot according to Comparative Examples.

FIG. 11 shows a graph and Table of representing isothermal oxidation test results of the Ti—Al-based alloy ingot having ductility at room temperature according to Embodiments of the present disclosure and the Ti—Al alloys according to Comparative Examples.

As shown in FIG. 11, as can be seen from the result of the isothermal oxidation test performed for 168 hours at 900° C., the Ti—Al alloys according to Embodiments 1 and 2 have oxidation amounts remarkably smaller than those of the Ti—Al alloys according to Comparative Examples 1 and 2.

Accordingly, the Ti—Al alloys according to Embodiments have high oxidation resistance and improved high-temperature characteristics as compared with the Ti—Al alloys according to Comparative Examples.

The test results show that the Ti—Al alloys according to Embodiments are far superior to the Ti—Al alloys according to Comparative Examples in high-temperature characteristics as well as room-temperature characteristics. Further, as shown in FIG. 12, major factors of microstructures of the Ti—Al alloys according to Embodiments and the Ti—Al alloys according to Comparative Examples are measured and compared with each other.

As shown in FIG. 12, even though the Ti—Al alloys according to Embodiments are considerably larger in grain size than the Ti—Al alloys according to Comparative Examples, the Ti—Al alloys according to Embodiments exhibit the above-mentioned characteristics. More specifically, while a thickness ratio $\gamma/\alpha_2$ of the $\gamma$ phase to the $\alpha_2$ phase is equal to or more than 2 in the alloys according to Embodiments of the present disclosure, a thickness ratio $\gamma/\alpha_2$ is equal to or less than 1.79 in the alloys according to Comparative Examples, so that there is a great difference therebetween.

In addition, the alloy of the present disclosure has a lamellar structure in which the $\alpha_2$ phases and the $\gamma$ phases are arranged subsequently and regularly, the $\gamma$ phase has a thickness of 100 nm to 200 nm, and the $\alpha_2$ phase has a thickness of 100 nm.

In contrast, in Comparative Examples, the $\alpha_2$ phases and the $\gamma$ phases are irregularly arranged, and the $\gamma$ phase has a thickness of 215 nm or 70.6 nm. This is outside a range of 100 nm to 200 nm which is a preferable $\gamma$-phase of the present disclosure.

Furthermore, in the alloys of Comparative Examples, the thickness ratio $\gamma/\alpha_2$ of the $\gamma$ phase to the $\alpha_2$ phase is equal to 1.79 or less, and this is a value small than the thickness ratio $\gamma/\alpha_2$ of the $\gamma$ phase to the $\alpha_2$ phase in the alloy of the present disclosure. Thus, in order to exhibit the aforementioned characteristics, the thickness ratio $\gamma/\alpha_2$ of the $\gamma$ phase to the $\alpha_2$ phase is preferably equal to or more than 2.

While exemplary embodiments are described above, it is not intended that these embodiments describe all those possible. Rather, the words used in the specification are words of description rather than limitation, and it is understood that various changes may be made without departing from the spirit and scope of the disclosure.

What is claimed is:

1. A Ti—Al-based alloy ingot having ductility at room temperature, wherein the Ti—Al-based ingot has a lamellar structure in which $\alpha_2$ phases and $\gamma$ phases are arranged sequentially and regularly, and a thickness ratio $\gamma/\alpha_2$ of the $\gamma$ phase to the $\alpha_2$ phase is equal to or more than 2, and wherein the Ti—Al-based alloy ingot includes 46 at % of aluminum (Al), 6 at % of niobium (Nb), 0.5 at % of tungsten (W), 0.5 at % of chromium (Cr), 0.3 at % of silicon (Si), 0.1 at % of carbon (C), and titanium (Ti) as a remainder, wherein the Ti—Al-based alloy ingot has a tensile strength of 640 MPa or more.

2. The Ti—Al-based alloy ingot of claim of claim 1, wherein the γ phase has a thickness of 100 nm to 200 nm.

3. The Ti—Al-based alloy ingot of claim of claim 1, wherein the $\alpha_2$ phase has a thickness of 100 nm or less.

4. A Ti—Al-based alloy ingot having ductility at room temperature, wherein the Ti—Al-based alloy ingot has a lamellar structure in which $\alpha_2$ phases and γ phases are arranged sequentially and regularly, the γ phase has a thickness of 100 nm to 200 nm, and the $\alpha_2$ phase has a thickness of 100 nm or less, and wherein the Ti—Al-based alloy ingot includes 44 at % of aluminum (Al), 6 at % of niobium (Nb), 0.5 at % of tungsten (W), 0.5 at % of chromium (Cr), 0.3 at % of silicon (Si), 0.1 at % of carbon (C), and titanium (Ti) as a remainder, wherein the Ti—Al-based alloy ingot has a tensile strength of 640 MPa or more.

5. A Ti—Al-based alloy ingot having ductility at room temperature in a casting state prior to a subsequent heat treatment, wherein the Ti—Al-based ingot has a lamellar structure in which $\alpha_2$ phases and γ phases are arranged sequentially and regularly, a thickness ratio $\gamma/\alpha_2$ of the γ phase to the $\alpha_2$ phase is equal to or more than 2, and wherein the Ti—Al-based alloy ingot includes 44-46 at % of aluminum (Al), 6 at % of niobium (Nb), 0.5 at % of tungsten (W), 0.5 at % of chromium (Cr), 0.3 at % of silicon (Si), 0.1 at % of carbon (C), and titanium (Ti) as a remainder, wherein the Ti—Al-based alloy ingot has a tensile strength of 640 MPa or more.

6. The Ti—Al-based alloy ingot of claim 5, wherein the γ phase has a thickness of 100 nm to 200 nm.

7. The Ti—Al-based alloy ingot of claim 5, wherein the Ti—Al-based alloy ingot has a yield stress of 590 MPa or more.

8. The Ti—Al-based alloy ingot of claim 5, wherein the Ti—Al-based alloy ingot has a strain of 0.384% or more.

* * * * *